US005261127A

United States Patent [19]

Tsipov

[11] Patent Number: 5,261,127

[45] Date of Patent: Nov. 16, 1993

[54] SANITARY UNIT

[76] Inventor: Michail Tsipov, 30-26 Brighton 14 St., Brooklyn, N.Y. 11235

[21] Appl. No.: 784,382

[22] Filed: Oct. 29, 1991

[51] Int. Cl.[5] ..... A47K 3/22

[52] U.S. Cl. ..... 4/597; 4/607

[58] Field of Search ..... 4/514, 596, 597, 605, 4/607, 608, 609, 610, 612, 598, 599, 600, 601, 602, 603, 604, 606, 611, 613, 614, 553, 554, 555, 557, 558

[56] References Cited

U.S. PATENT DOCUMENTS

| | | | |
|---|---|---|---|
| 4,508,141 | 4/1985 | Tsipov | 4/628 X |
| 4,594,742 | 6/1986 | Zeigler et al. | 4/607 |

FOREIGN PATENT DOCUMENTS

| | | | |
|---|---|---|---|
| 2308235 | 8/1974 | Fed. Rep. of Germany | 4/596 |
| 3324277 | 4/1984 | Fed. Rep. of Germany | 4/514 |
| 3627807 | 2/1988 | Fed. Rep. of Germany | 4/596 |
| 1139093 | 6/1957 | France | 4/596 |
| 0495296 | 6/1954 | Italy | 4/597 |
| 0580956 | 8/1958 | Italy | 4/514 |

*Primary Examiner*—Thomas B. Will
*Assistant Examiner*—W. Morris Worth
*Attorney, Agent, or Firm*—Ilya Zborovsky

[57] ABSTRACT

A sanitary unit comprises a sink turnable between a horizontal working position and a vertical nonworking position, a shower head located above the sink when it is in the working horizontal position, a shower curtain arranged to lose an area under the shower head when the user takes a shower and movable between the open position and a closed position, and a control element formed so that when the sink is movable from its nonworking position to its working position, the shower curtain is moved from its closed position to its open position and then the sink is moved from its working position to its nonworking position, the shower curtain is moved from its open position to its closed position, so that in the nonworking position of the sink a user can take a shower under the shower head with the shower curtain simultaneously closed.

8 Claims, 6 Drawing Sheets

SANITARY UNIT

BACKGROUND OF THE INVENTION

The present invention relates to a sanitary unit and more particularly to a unit including a sink, a shower, a shower curtain, etc.

Due to shortage of space in buildings, hotels, motels, clubs, ships, mobile houses, etc. it is desirable to design sanitary units as small as possible and at the same time so that it can be used for all purposes achieved in standard sanitary units. Many proposals have been made to economize the space in the sanitary units. There is also a tendency to build controlled dwellings, and to use the same space for different functions.

SUMMARY OF THE INVENTION

Accordingly, it is an object of the present invention to provide a sanitary unit which is compact, saves space and the same time provides all necessary operations for a user.

In keeping with these objects and with others which will become apparent hereinafter, one feature of the present invention resides, briefly stated, in a sanitary unit which has a sink movable between a horizontal working position and a vertical storage position, a shower head located above the sink when it is in working position, a shower curtain movable between an open position and a closed position, a means for controlling the sanitary unit so that when the sink is moved to its vertical storage position then the curtain is moved to its closed position so that a person can take a shower under the shower head with the closed shower curtain and when the shower curtain is moved to its open position, the sink is moved to its horizontal working position so that the user can use the sink.

A simple control of the devices is provided. Such units can be also produced and transported as finished blocks or panels.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 11:
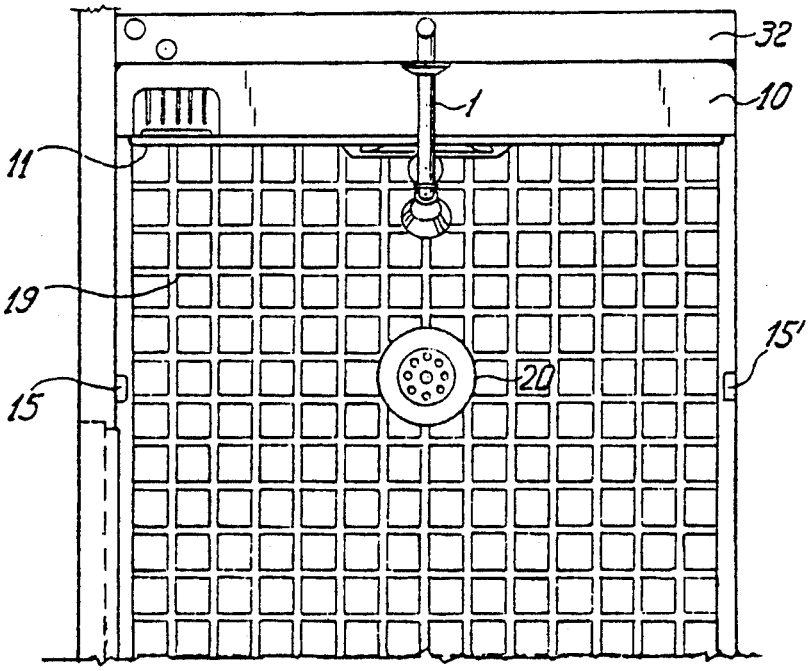
FIG. 11 is a plan view substantially corresponding to the view of FIG. 10 and showing the sink in a nonworking lower position.
Figure 12:
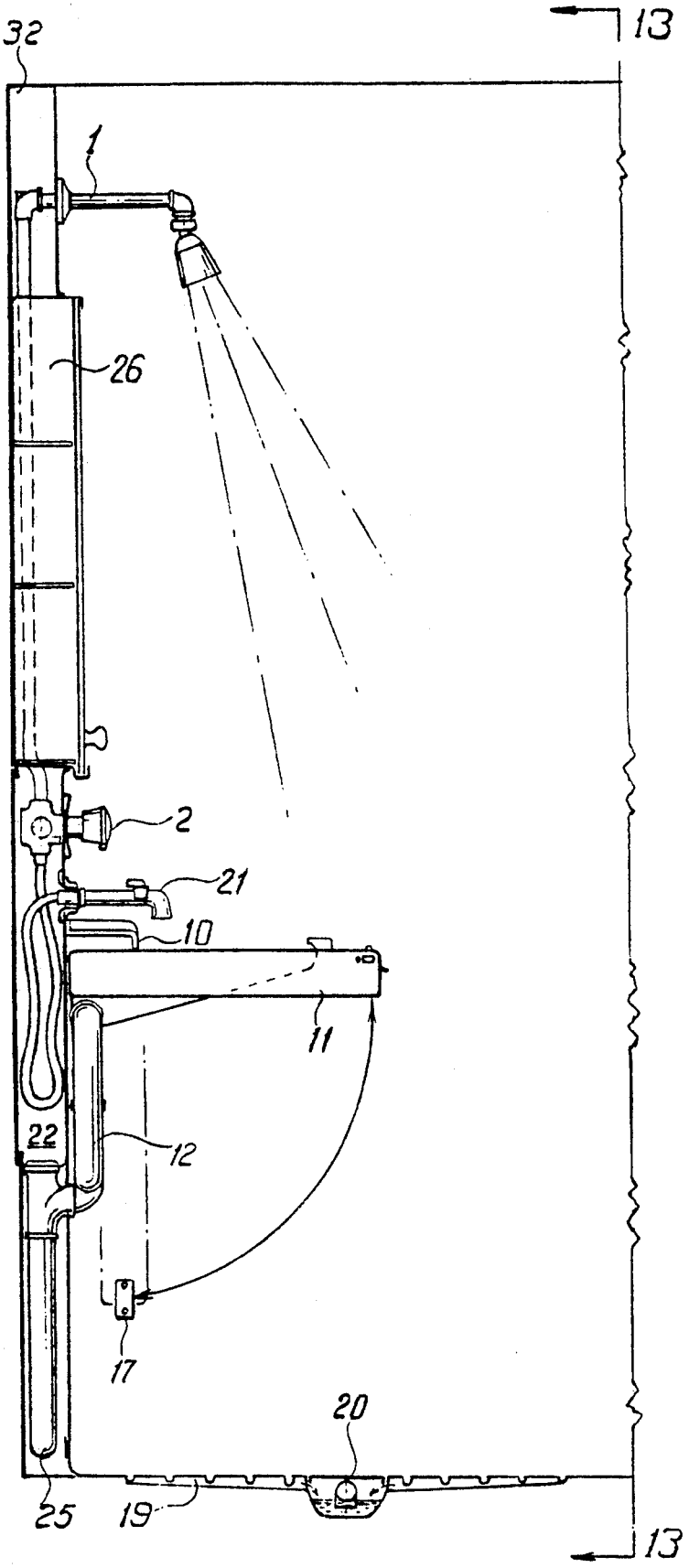
FIG. 12 is a side view of the shower part of the sanitary unit with the sink in the working position.
Figure 13:
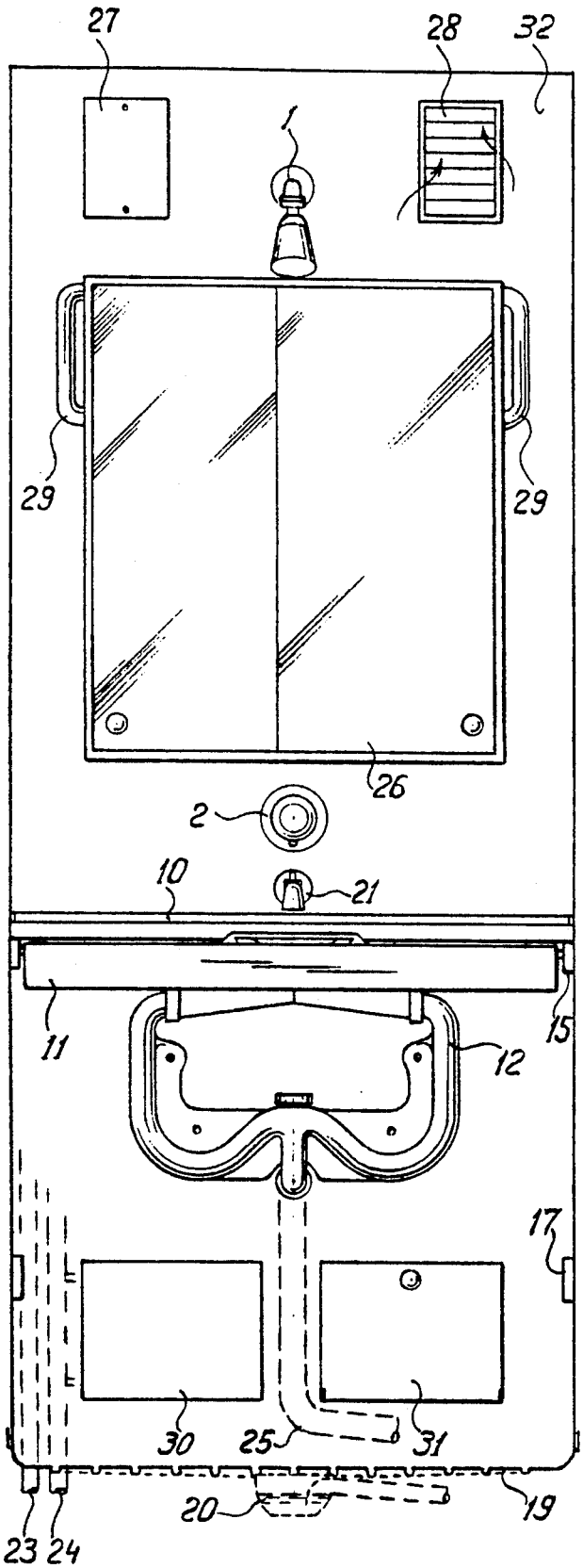
FIG. 13 is a front view of the shower part of the sanitary unit.

The sanitary unit in accordance with the present invention has a shower unit which is a standard unit as shown in FIGS. 2, 3,6,7,11, 12 and 13. It has a shower arm 1 which can be of any shape and size, for example as shown in FIGS. 11, 12 and 13. A mixer of cold and hot water 2 can be also of any design, for example with one control hand shown in FIGS. 12 and 13. Also, a mixer with one handle and closing soap dish can be used as disclosed, for example in U.S. Pat. No. 4,508,141.

Figure 2:
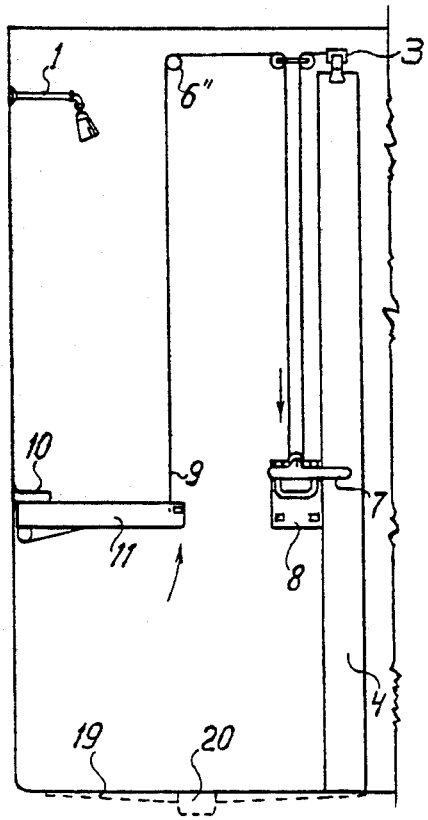
FIG. 2 is a schematic side view of an inventive sanitary unit.
Figure 3:
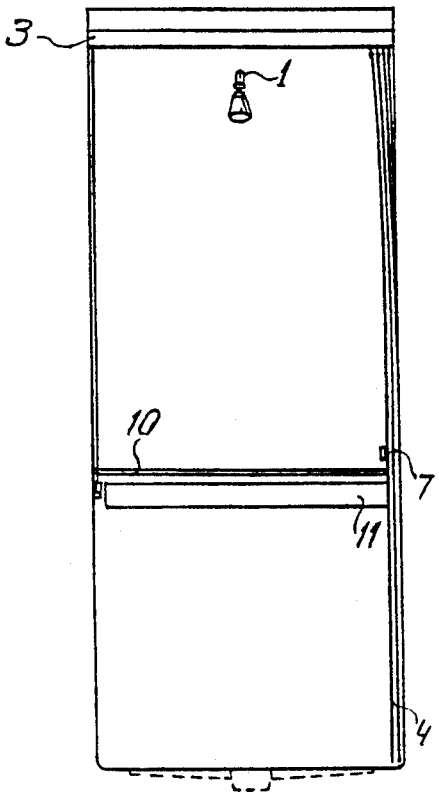
FIG. 3 is a schematic front view of the inventive sanitary unit.
Figure 6:
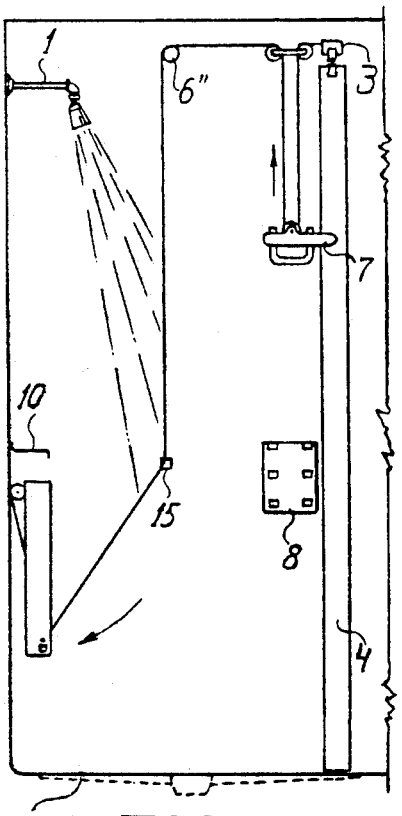
FIG. 6 is a view substantially corresponding to the view of FIG. 2, but showing the sanitary unit in another position.
Figure 1:
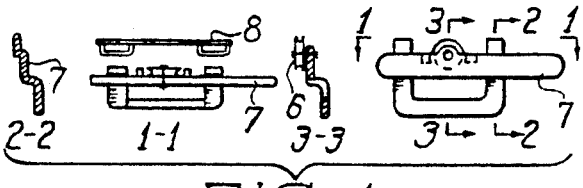
FIG. 1 is a view showing control elements for controlling simultaneous operation of a sink and a shower curtain.
Figure 5:
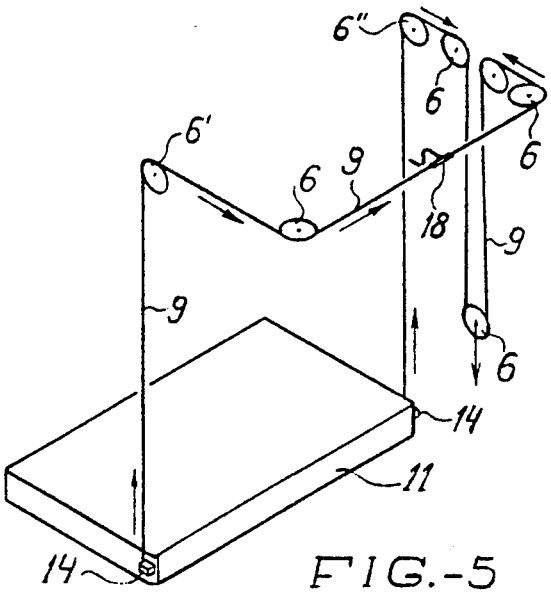
FIG. 5 is a perspective view of a sink with control elements.
Figure 4:
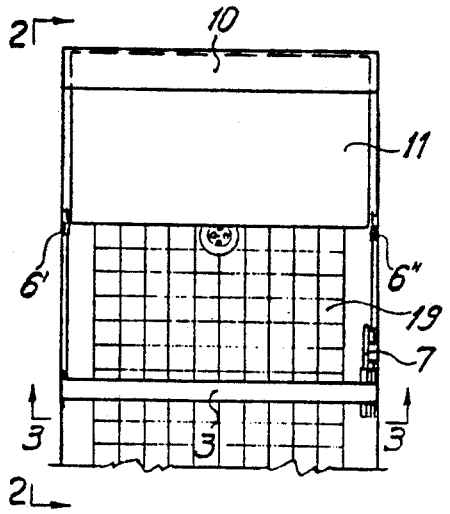
FIG. 4 is a schematic plan view of the inventive sanitary unit.
Figure 7:
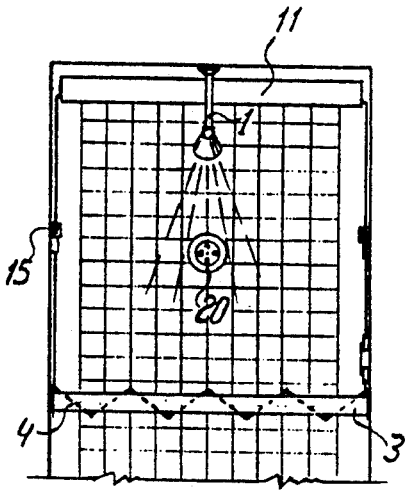
FIG. 7 is a plan view of the sanitary unit of FIG. 6.
Figure 8:
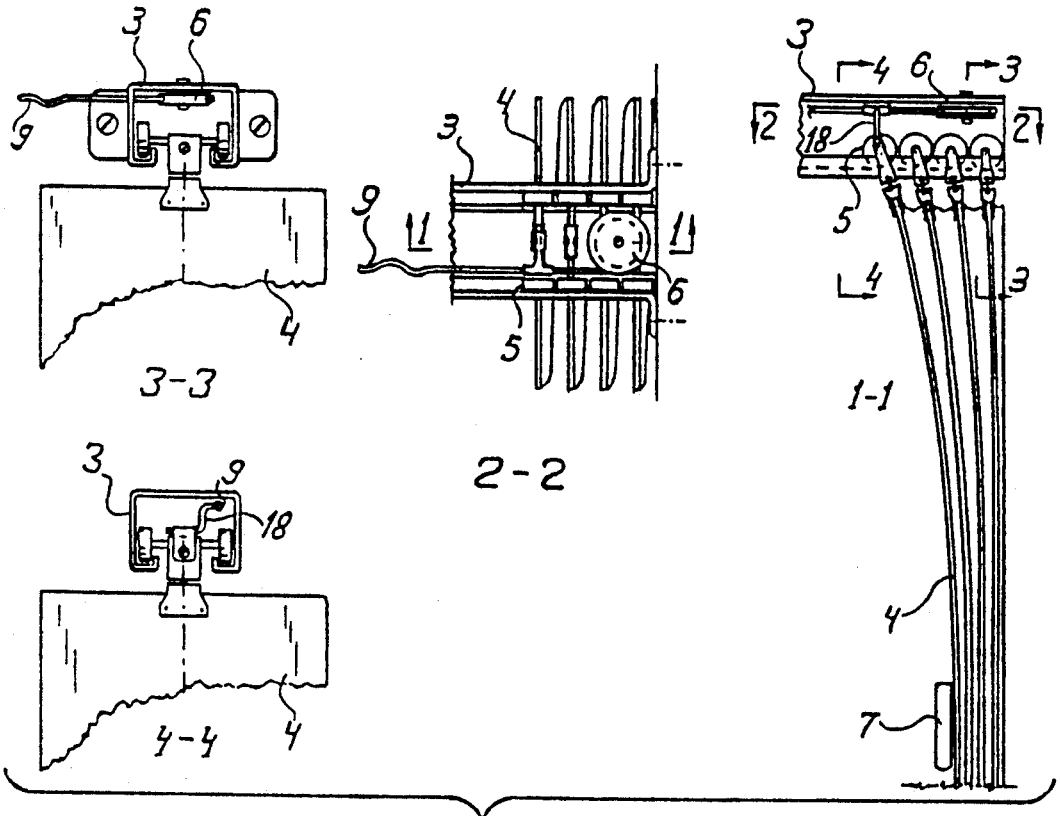
FIG. 8 is a view showing a modification of the shower curtain.

The sanitary unit has a shower curtain which protects a space outside of the shower space from water. It can be of any design. Moreover, it is preferable to provide the shower curtain as shown in FIG. 8. A standard metal element 3 can be used to support the shower curtain and can be formed of a B-line profile, for example 14 gauge. The length of the element 3 is equal to the width of the sanitary unit. The ends of both sides are bent and have openings for fixing screws shown in FIGS. 2, 3, 4, 7, 8. If a door is in the zone of the curtain, then the element 3 is arranged above the door. Rollers 5 which are connected in pairs are introduced into inner grooves of the element 3. A closed plate of a metal strip is arranged on each axle and connected by a screw. Another plate composed of a strip is riveted to one of the elements of the the symmetrically bent shower curtain 4. Both plates are connected by rivets not tightly, so that the suspending elements can freely turn around the vertical axis of symmetry. In the proposed folded construction of the curtain the rigid suspending elements are arranged in alternating order with soft inserts. Such curtain reaches the floor in its open condition and in this condition would be almost immovable so as to reliably protect the dry area of the sanitary unit from the action shower as shown in FIGS. 6 and 7.

Figure 16:
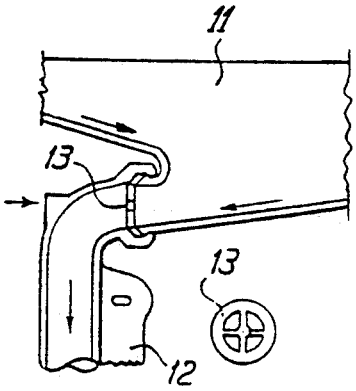
FIG. 16 is a view showing an element of a left turning unit of the sink.
Figure 15:
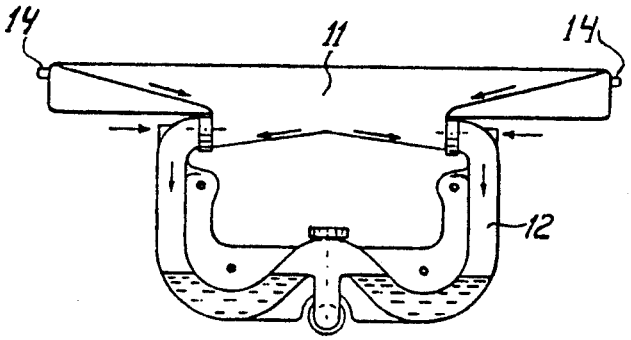
FIG. 15 is a section of the sink in a working position and its part on the wall, with directions of liquid movement identified by arrows.
Figure 14:
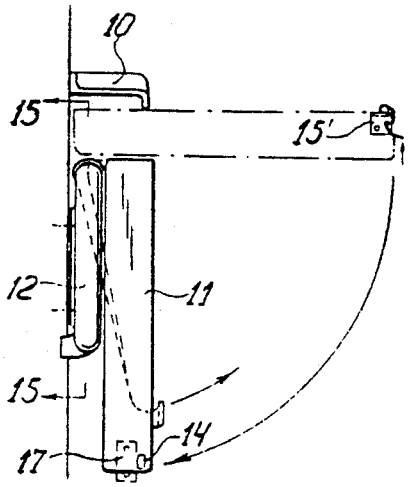
FIG. 14 is a side view with the lowered sink in the working position and its wall part.
Figure 18:
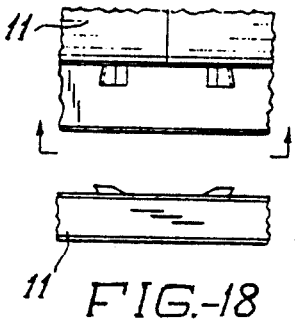
FIG. 18 is a view showing lugs on the front board of the sink.

The sanitary unit further has a sink which is identified with reference numeral 11. It has a rectangular shape on a plan view. The width from the first to the rear edge is of a standard size. The length from the left to the right edge can correspond to any standard width of the shower area. The surface of the sink has inclines for water flow which are identified with arrows as shown in FIGS. 10, 12, 14, 15. A special shallow recess for receiving water is located in the center of the silk. The bottom of the sink has inclines for directing splashes from the vertically falling water to the rear wall of the sink, to the left and to the right. In other words, away from the user. Only water from the surface of the sink flows to two drainage openings in the rear area of the sink, in the right and left walls of the shallow sink. The openings are round and can be provided with grates and plugs. The drainages of the sink are ended in pipes which extend into funnels of a drainage-support element 12. The element 12 has outlet passages which merge into a hydrolocks, unscrewable covering the center and drainage to a sewer. The element 12 can be made of an elastic plastic material which during connecting with the sink can move the funnels to the sides and then press them onto the pipes of the sinks by pressing the stops at left and right sides of the funnels, as can be seen in FIGS. 15 and 16. The funnels can be preliminarily provided with washers, with nets in the center 13, composed for example of tetrafluoroethylene. This connection which can also use other types of couplings makes possible easy and free turning of the sink and so that it maintains required tightness and wear resistance. The element 12 is mounted to a wall, for example by screws. The sink has four supports in plan. The rear side is supported with the pipes on the element 2. The front side of the sink needs the supports when the sink is lifted and is in the horizontal, working position. In order to provide the front supports at the right and left edges of the sink, lugs formed as thorns 14 are provided. Angled stops 15 are arranged on the walls and act as limiting elements to fix the horizontal position of the sink. In order to keep the sink in the working position, there are variants of suspended and fixed supports. In the central part, on the front edge of the sink there are lugs with side surfaces having the dove-tail shape. In the horizontal plane, the side surfaces of the lug have conical feet in order to put a handle, as shown in FIG. 18. near the rear wall, an immovable shelf 10 is mounted for soap and other accessories. When the sink is in the lowered position, it is located under the shelf and beyond a working zone of a user who stands and takes the shower.

Figure 17:
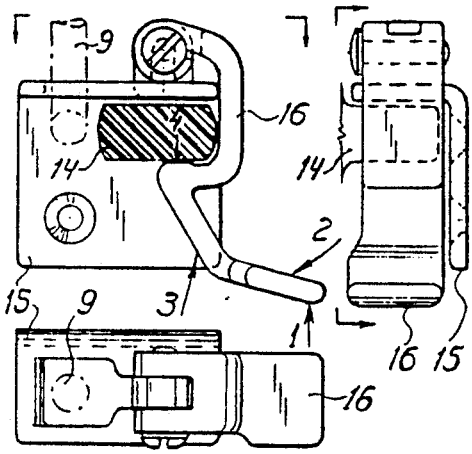
FIG. 17 is a view showing an element of a right wall support of the front part of the sink.
Figure 9:
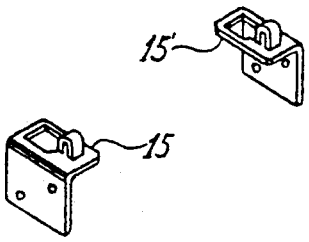
FIG. 9 is a perspective view of a right and a left wall stops for fixing the sink in a working position.

A wall stop 15 shown in FIGS. 17 and 9 can be made by stamping and have a vertical part with openings for mounting by screws to the wall, and a horizontal part shaped as a shelf-stop. The shelf has an opening for a cord when the sink is suspended. At the other side on the shelf there is a loop for the variant of a stamped, self-locking element 16 formed as a strap. The strap 16 is for a fixed support variant for the sink. The strap is mounted in the loop of the stop 15 by a screw which is screwed into the thread in a bent fork of the upper part of the strap, but extends freely in the loop. Therefore the strap can easily and freely turn together with the screw above the loop. The lower end of the strap is bent and forms a handle for fingers when it is necessary to turn the strap upwardly. The stop 15 and the strap 16 have a left and a right variant. When the sink is lowered its thorns 14 abut against dampers 17 for example of rubber. The dampers 17 are screwed to the side walls in respective places.

The sanitary unit has a floor which is formed as a single panel 19 performing two functions, namely the function of a floor and the function of a tray in the zone of the shower. Therefore the whole surface of the floor is horizontal with a single level. The floor has a relief for example subdividing its surface into several tiles. Grooves formed as passages are formed between the tiles. In the square of the shower zone the grooves are inclined toward an element 20 as shown in FIGS. 10, 11, 12, 13. The surface of the tiles are inclined and has a structure against slippage as well as possesses certain wear resistance. Therefore when the shower is working water flows from the tiles into the grooves and then water is withdrawn to the element 20. The element 20 has a cover for observation and cleaning, and also a hydro lock before the discharge to the sewer. If the door of the sanitary unit is in the zone of action of the shower, the door threshold must have an incline toward the interior of the sanitary unit and overlap the board of the floor.

The sink has a faucet spout 21 with a faucet in its front part. The spout 21 is mounted in a support and is removable. For this purpose the spout is connected with a common mixer 2 by a flexible, metallized hose. The hose is located behind a front wall in a nische 22 and can be easily removed from it and moved backwards. The spout located in the support formed as a nest performs the function of a faucet for the sink, and when it is moved out it can perform other functions in the sanitary unit. A supply of cold and hot water is connected with the mixer. Not shown faucets are provided on the supply elements. The nische is closed by an observation cover which can be at front if needed. Behind the front wall it is possible to arrange a standpipe of cold water supply 23, as well as a stand pipe of hot water supply 24, and a sewer drainage 25. Above the sink and the mixer and also partially in the nische, there is a drawer 26 with shelves for accessories. Drawer can be closed by spreadable or foldable doors with mirrors on the outside surface.

Figure 10:
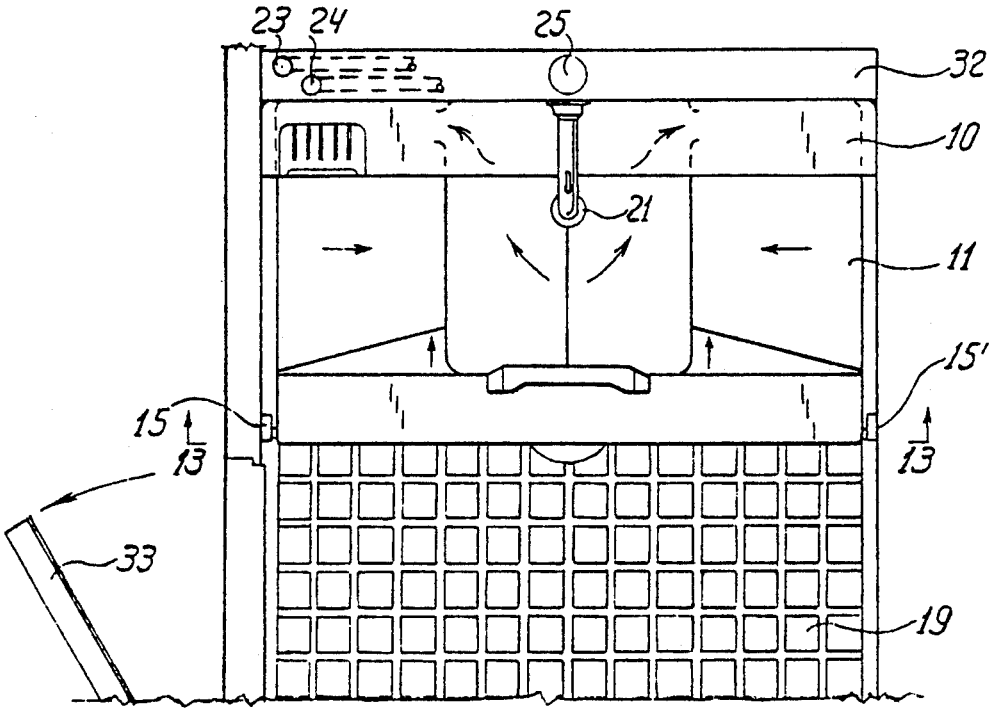
FIG. 10 is a plan view showing a sink located in the shower part of the sanitary unit and other associate elements.

A passage with an opening 27 can be arranged under the drawer for supplying an inflowing air into the sanitary unit. At the right side there is a passage with an opening 28 for a ventilation. Illuminating elements 29 can be arranged to the, left and right side of the drawer. Under the sink in a nishe 30 can be a device for heating, and in a nische 31 can be is a steam bath generator for dry and wet vapor, not shown. All devices, units and communications can be mounted in a single block and together form a panel 32. A door 33 can be arranged as shown in FIG. 10.

The sanitary units provided with a joint control for the sink and the shower curtain is shown in FIGS. 1-9. At the periphery of the shower zone, at the level of the basic element 3 of the shower curtain in the element 3 at its ends there are rollers 6 for the cord 9 composed for example of nylon. One end of the cord fixed in the sink and tied in a knot extends from the opening in the left edge of the sink near the thorn 14, then extends through the opening of the stop 15 and goes vertically upwardly to the left roller 61. Then the cord 9 turns over the roller and extends horizontally to the element 3, passes in the opening in its wall opposite to the inner roller, of the left end. When the cord passes over this roller inside, it passes and goes over the roller of the right end and extends through the opening in the wall of element 3 outwardly. Near the right or left end, there are two rollers connected in a pair for passing of a loop of the cord to the roller mounted on a head bar 7. Then, after the rollers connected in pairs, the cord passes to a right roller 6'', goes over it and goes down, passes through the opening of the right stop 15' and into the opening in the right edge of the sink. This also is tied in a knot.

In the position in which the sink is lifted and the shower curtain is removed, the cord is tightened and the head bar is in its lowered, fixed position on the wall member 8. For this purpose the head bar has a handle in its lower part and catches in the lower part to engage in ears of wall board 8. Between the catches there is a pulley for the loop of the cord A metal element 18 formed as a guide is arranged in the element 3 on the cord. The bent part of the guiding pin is connectable with the rollers of the extreme suspension of the shower curtain as shown in FIG. 8.

The systems of the sanitary unit operates in the following manner.

The strap 16 under the action of its own weight is always in the position shown in the drawing and supported on the edge of the stop 15 as seen in FIG. 17. This position of the strap is selected so that its center of gravity is always on a horizontal end and displaced from its axis of turning so as to form a torque into the interior shown by the arrow 2. At the moment when the sink is lifted the thorn 14 touches the strap from the inner side, see arrow 3 and starts sliding over its surface and move it to the side opposite to the arrow 2. When the thorn passes to the end and abuts into the stop 15, a gap is formed between the lower side of the thorn and the supporting knee of the strap so that the knee can pass under the thorn and the strap can turn to its initial position. The released sink lowers with the thorn onto the knee and passes its pressure onto it in the area of the arrow 4. This force will hold the strap and turn it inside since it is directed along a horizontal away from the axis of turning of the strap.

In order to take a shower a user stretches his hand to the right or to the left so as to grasp the handle of head bar 7 and presses the handle of the bar down so as to disengage it from the wall element 8. The head bar releases the tightening of the cord 9, and the sink being released from the tightening force lowers downwardly under the action of its own weight. When the sink is lowering it pulls the cord downwardly from both sides equally, and the loop which suspends the head bar is reduced and releases the cord to the left and to the right from the pairs of pulleys also equally. Therefore the cord which presses inside the element 3 starts moving to the side, where the cord is also pulled down but does not have a compensation of the shortening loop, or in other words in this variant from the right to the left. The element 18 mounted on the cord also moves to the left and pulls the extreme section of the shower curtain so as to unfold it. As a result the sink lowers and goes under the shelf and the shower curtain limits the zone of the shower from another part of the sanitary unit. Now, the user can take a shower. After taking the shower, the user stretches the hand to the right or the left, takes the handle of the head a bar and pulls downwardly. The cord which forms the loop starts lengthening, and both ends mounted in the edges of the sink start shortening so as to lift the sink. The cord in the element 3 moves to the side of lowering loop and the element 18 will fold the shower curtain back. After this, the user turns the legs of the head bar to one of the pairs of ears in the element 8 and engages the bar 7. The long end of the head bar presses the folded shower curtain to the wall. Now the user can leave the area of the shower and take a towel FIGS. 2,3,8.

If the suspended support of the sink is not comfortable for the user, he can put the strap 16 on the stops 15. Then, when the sink is being aised 1 the strap will automatically lock it. For lowering of the sink after the release of the head bar from its engagement, the straps must be disengaged from the thorns of the sink by pushing upwards with the finger the handles, see FIGS. 14, 17.

It is therefore to be clear that in order to use the sink it is sufficient to approach the sink, to open a faucet and mixer, and in order to use the shower it is sufficient to approach the sink and to release on the wall one handle from the engagement, then to close the faucet of the sink and to open the mixer. The lifting of the sink takes place and is connected only with the opening of the shower curtain.

The invention is not intended to be limited to the details shown, since various modifications are possible without departing from the spirit of the present invention.

What is desired to be protected by Letters Patent is set forth in the appended claims.

I claim:

1. A sanitary unit, comprising a plurality of walls defining a space; a sink located in said space and mounted on one of said walls; means for supporting said sink so that said sink is turnable between a horizontal working position and a vertical non-working position; a shower head located in said space and mounted on one of said walls above said sink when said sink is in said working horizontal position; means for supplying water to said sink and said shower head; a shower curtain; means for supporting said shower curtain so that said shower curtain is movable between an open position and a closed position; and means for connecting and moving said sink and said shower curtain so that when said sink is moved from said non-working position to said working position, said shower curtain is moved from said closed position to said open position, and then when said sink is moved from said working position to said non-working position said shower curtain is moved from said open position to said closed position, so that in said non-working position of said sink a user can take a shower under such shower head with said shower curtain simultaneously closed.

2. A sanitary unit as defined in claim 1, wherein said sink moves from said working position to said non-working position downwardly to assume a vertical orientation.

3. A sanitary unit as defined in claim 1, wherein said means for supporting said sink including draining passages arranged on one of said walls of the sanitary unit, said sink having a shallow provided with a recess which in said non-working position of said sink is located between said draining passages.

4. A sanitary unit as defined in claim 1, and further comprising a stationary shelf mounted on one of said walls, said sink in said non-working position being completely located under said stationary shelf and out of a zone needed for a standing user.

5. A sanitary unit as defined in claim 1, wherein said means for supplying water including a control element for mixing hot and cold water, said sink and said shower head being located so that a user can use said control element both for use of said sink and said shower head and can stand on a same floor area during the use of said sink and said shower head.

6. A sanitary unit as defined in claim 1, wherein said sink has draining openings and couplings, said draining openings being located in a vertical plane and merging into said couplings.

7. A sanitary unit as defined in claim 1; and further comprising wall-mounted stops, said stops being formed as self-catching units and forming supports for said sink in said working position.

8. A sanitary unit as defined in claim 1; and further comprising a floor element having a plurality of channels to operate as a floor and as a tray.

* * * * *